US006557717B1

(12) United States Patent
Keck

(10) Patent No.: US 6,557,717 B1
(45) Date of Patent: May 6, 2003

(54) NON-SPILL BEVERAGE CONTAINER

(76) Inventor: David Keck, 362 So. Canterbury Rd., Canterbury, CT (US) 06331

( * ) Notice: Subject to any disclaimer, the term of this patent is extended or adjusted under 35 U.S.C. 154(b) by 0 days.

(21) Appl. No.: 10/015,228

(22) Filed: Dec. 12, 2001

(51) Int. Cl.[7] ..... A47G 19/22

(52) U.S. Cl. ..... 220/254.9; 220/345.1; 220/715; 222/470

(58) Field of Search ..... 220/254.9, 715, 220/345.1, 345.2, 345.4; 222/470, 471, 511, 515

(56) References Cited

U.S. PATENT DOCUMENTS 2,312,584 A * 3/1943 Peterson ..... 222/470
2,353,132 A * 7/1944 Frank ..... 366/243
2,589,890 A * 3/1952 Stoecker ..... 222/86
3,967,748 A * 7/1976 Albert ..... 220/715
3,972,443 A * 8/1976 Albert ..... 220/715
4,094,433 A * 6/1978 Numbers ..... 220/715
4,099,642 A * 7/1978 Nergard ..... 220/715
4,276,992 A * 7/1981 Susich ..... 220/254.5
4,750,644 A * 6/1988 Kolody ..... 222/144.5
4,921,146 A * 5/1990 Salzmann ..... 222/473
6,098,834 A * 8/2000 Hatsumoto et al. ..... 220/715

* cited by examiner

*Primary Examiner*—Lee Young
*Assistant Examiner*—James Smalley
(74) *Attorney, Agent, or Firm*—Goldstein & Lavas, P.C.

(57) ABSTRACT

A container that is adapted for holding a quantity of a beverage therein. The container has an open upper end and a closed lower end. A cover member is adapted for removably coupling with the open upper end of the container. The cover member includes a planar circular plate. The circular plate has an internal chamber. The circular plate has an aperture therethrough and through the internal chamber. The cover member includes a slide plate disposed within the internal chamber for selectively closing the aperture. A closing assembly is adapted for maintaining the slide plate in a closed orientation over the aperture of the cover member.

3 Claims, 4 Drawing Sheets

NON-SPILL BEVERAGE CONTAINER

BACKGROUND OF THE INVENTION

The invention relates to a non-spill beverage container that requires a user to select when, or when not to drink their beverage.

The present invention requires a user to press downwardly on a button to expose a drinking aperture that will allow a beverage to be dispensed through the aperture. Once the button has been released, the drinking aperture will no longer be exposed thereby precluding the inadvertent dispensing of the beverage. Thus, the user determines when the beverage is dispensed and the pressing of the button, will not allow any of the beverage to spill. Many drink receptacles are provided with closure means to prevent spilling, but all of these devices require the user to manually close the closure means leaving to chance the possibility of forgetting and the eventual spilling of the beverage.

Several references show various receptacle devices with closures. U.S. Pat. No. 4,303,173 to Nergard discloses a drinking receptacle with a cover containing a finger actuated valve using a lever located above the handle, to prevent spills. U.S. Pat. No. 5,199,597 to Gladish discloses a container with a spring activated self closing lid. U.S. Pat. No. 4,276,992 to Susich and U.S. Pat. No. 6,098,834 to Hatsumoto disclose additional beverage containers with valve assemblies integral with the closure of the receptacle.

While these units may be suitable for the particular purpose employed, or for general use, they would not be as suitable for the purposes of the present invention as disclosed hereafter.

SUMMARY OF THE INVENTION

It is an object of the invention to produce a non-spill beverage container that requires a user to select when, or when not to drink their beverage including a container adapted for holding a quantity of a beverage therein. The container has an open upper end and a closed lower end. The open upper end has external threads thereon. A cover member is adapted for removably coupling with the open upper end of the container. The cover member includes a planar circular plate. The cover member includes a lower peripheral flange extending downwardly from the circular plate. The lower peripheral flange is internally threaded for engaging the external threads of the open upper end of the container. The cover member includes an upper peripheral flange extending upwardly from the circular plate. The circular plate has an internal chamber. The circular plate has an aperture therethrough and through the internal chamber. The cover member includes a slide plate disposed within the internal chamber for selectively closing the aperture. The cover member has an inverted L-shaped handle secured to the lower peripheral flange. The handle has an upper horizontal segment and a lower vertical segment. A closing assembly is adapted for maintaining the slide plate in a closed orientation over the aperture of the cover member. The closing assembly includes a release button extending outwardly of the upper horizontal segment of the handle of the cover member. The release button has a plunger shaft extending downwardly therefrom interiorly of the lower vertical segment of the handle. The plunger shaft has a spring disposed on a lower end thereof biasing the plunger shaft and the release button upwardly. The closing assembly includes an inner gear track and an outer gear track. The inner gear track is disposed horizontally within the internal chamber and coupled with the slide plate. The outer gear track is coupled with the plunger shaft. The closing assembly includes a drive shaft extending between the inner and outer gear tracks. The drive shaft has an inner end and an outer end. The inner and outer ends each have a gear secured thereto for engaging the inner and outer gear tracks.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
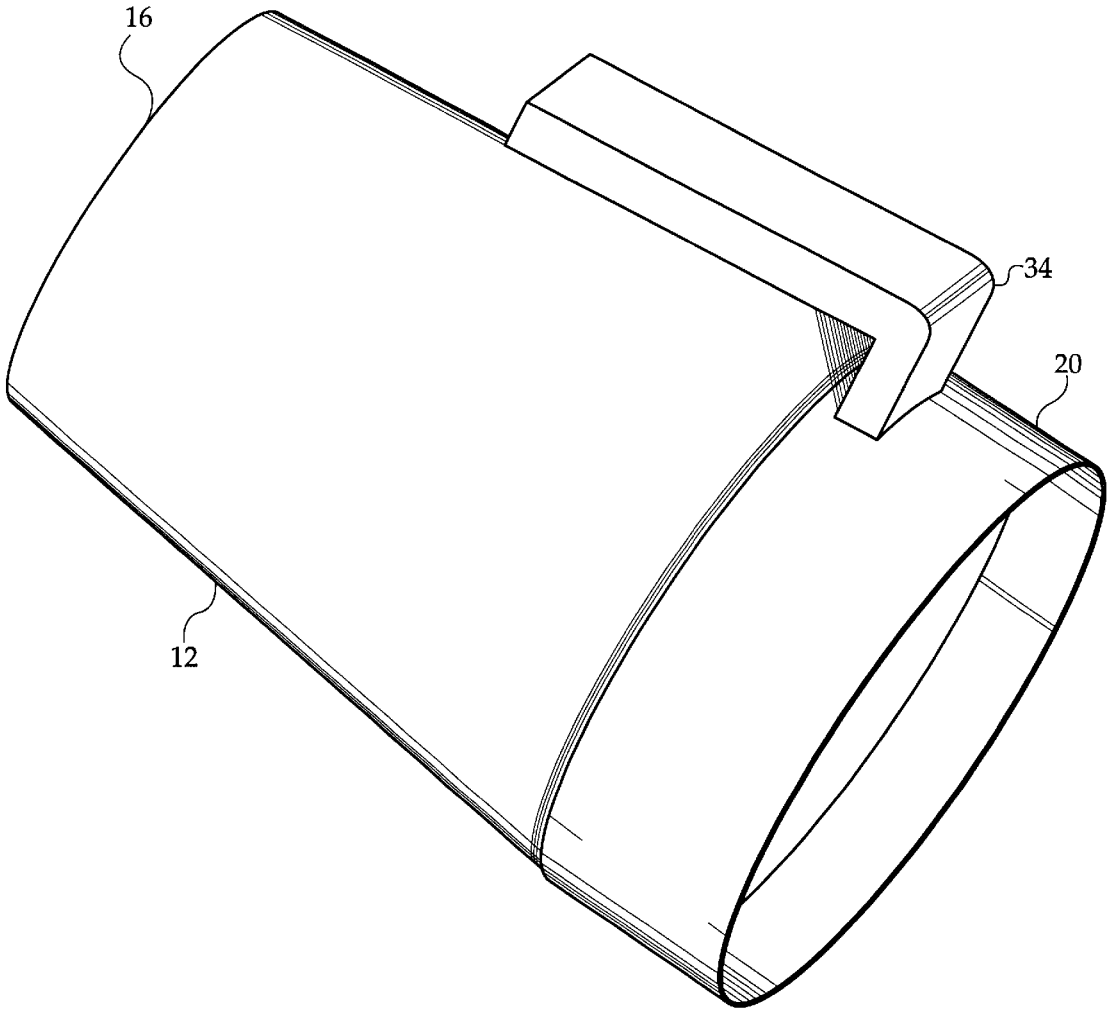
FIG. 1 is a perspective view of the present invention illustrated in an inverted orientation.
Figure 2:
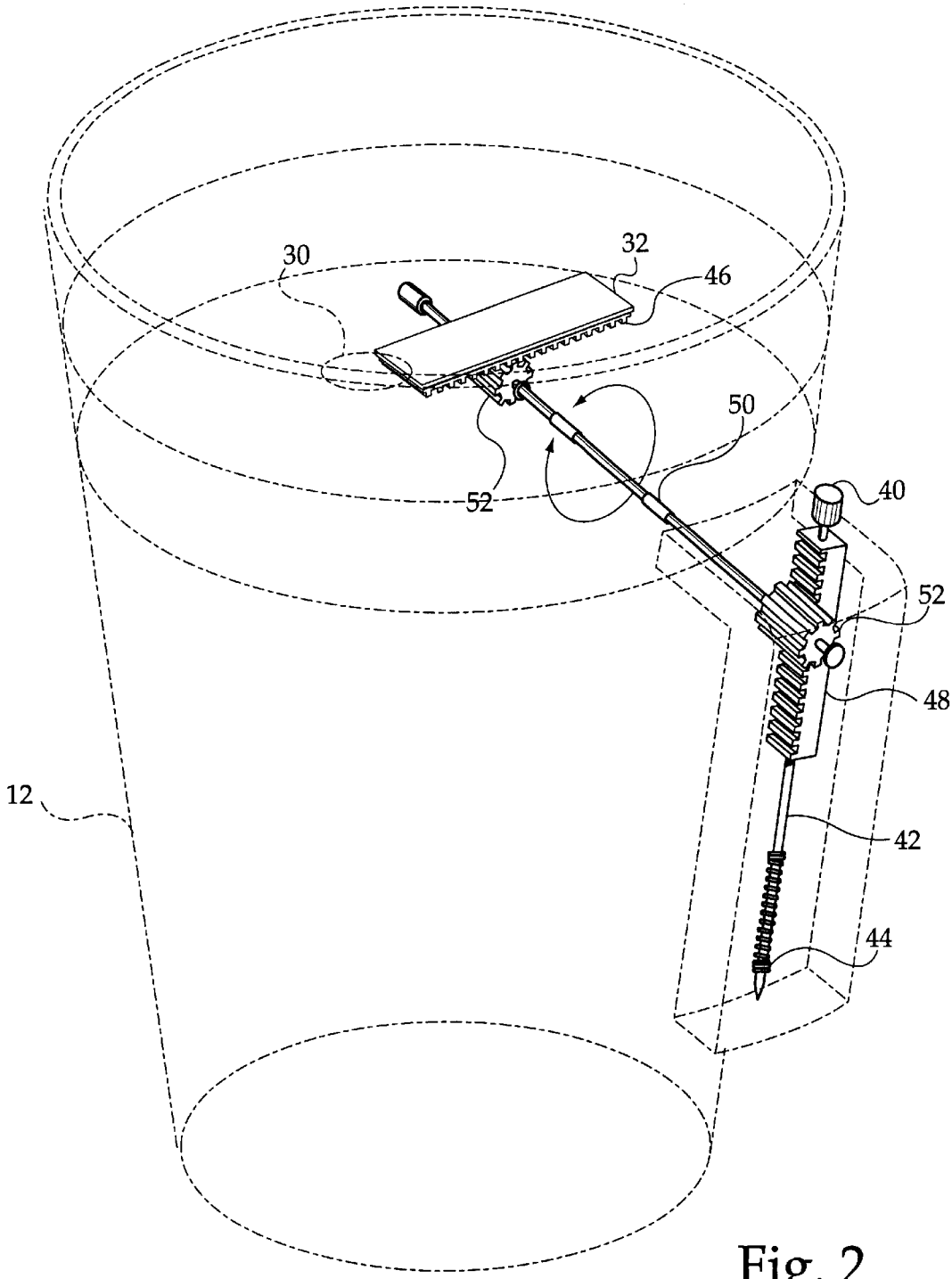
FIG. 2 is a top perspective view of the present invention illustrating the closing assembly thereof.
Figure 3:
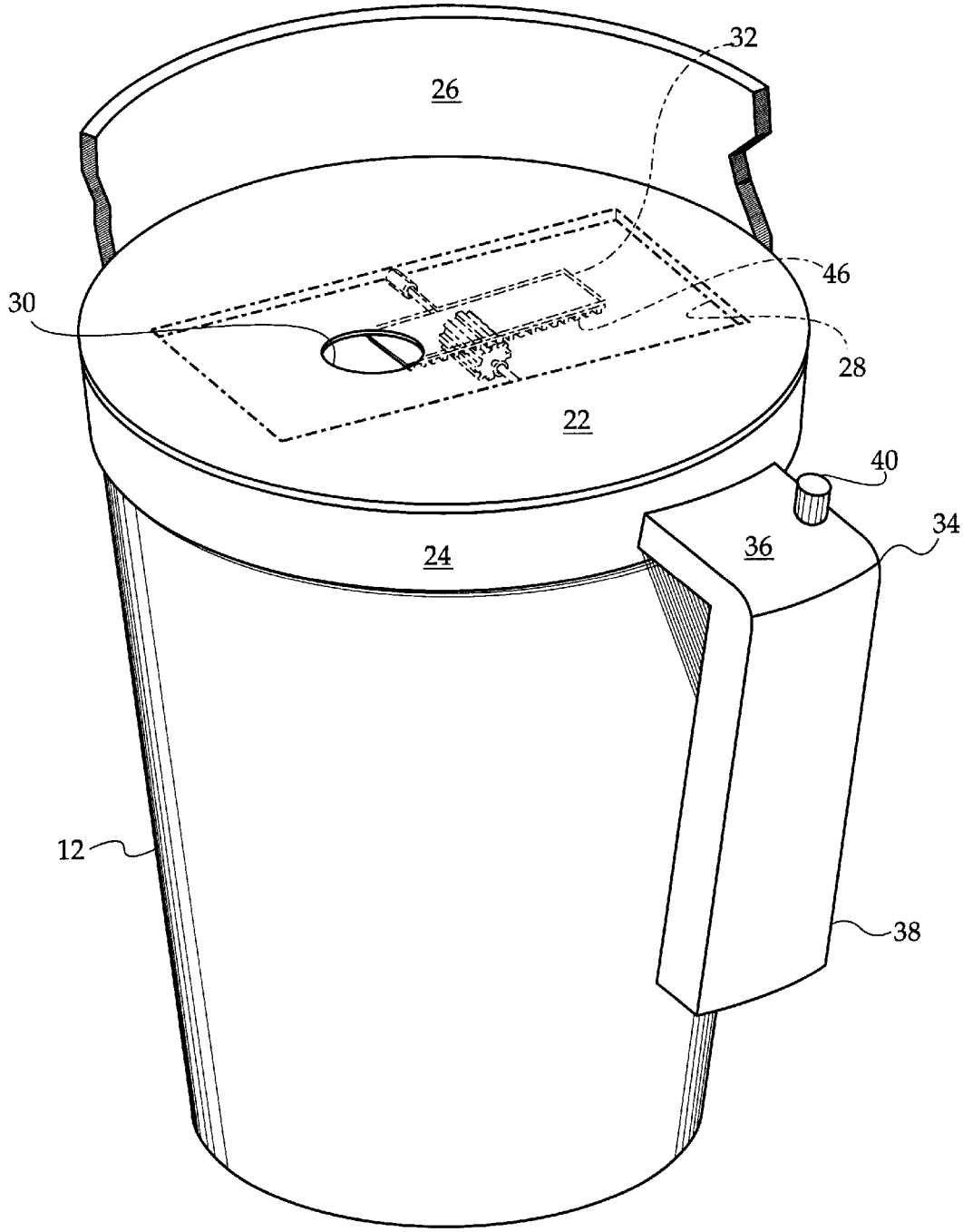
FIG. 3 is a top perspective view of the present invention illustrating the cover member thereof.
Figure 4:
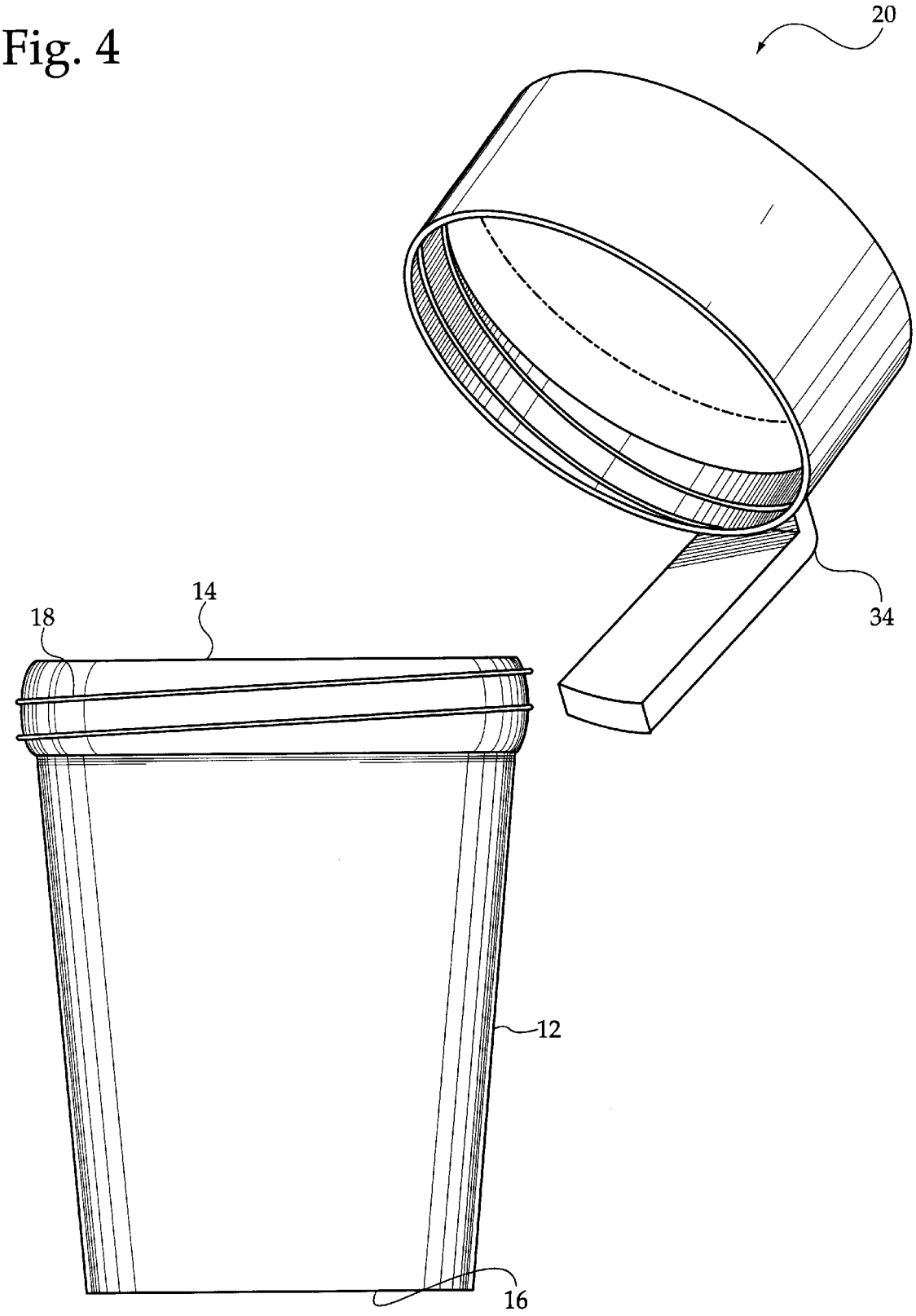
FIG. 4 is an exploded side view of the present invention.

It will be noted in the various figures that the device relates to a non-spill beverage container that requires a user to select when, or when not to drink their beverage. In its broadest context, the device consists of a container, a cover member, and a closing assembly. Such components are individually configured and correlated with respect to each other so as to attain the desired objective.

The container 12 is adapted for holding a quantity of a beverage therein. The container 12 has an open upper end 14 and a closed lower end 16. The open upper end 14 has external threads 18 thereon.

The cover member 20 is adapted for removably coupling with the open upper end 14 of the container 12. The cover member 20 includes a planar circular plate 22. The cover member 20 includes a lower peripheral flange 24 extending downwardly from the circular plate 22. The lower peripheral flange 24 is internally threaded for engaging the external threads 18 of the open upper end 14 of the container 12. The cover member 20 includes an upper peripheral flange 26 extending upwardly from the circular plate 22. The circular plate 22 has an internal chamber 28. The circular plate 22 has an aperture 30 therethrough and through the internal chamber 28. The cover member 20 includes a slide plate 32 disposed within the internal chamber 28 for selectively closing the aperture 30. The cover member 20 has an inverted L-shaped handle 34 secured to the lower peripheral flange 24. The handle 34 has an upper horizontal segment 36 and a lower vertical segment 38.

The closing assembly is adapted for maintaining the slide plate 32 in a closed orientation over the aperture 30 of the cover member 20. The closing assembly includes a release button 40 extending outwardly of the upper horizontal segment 36 of the handle 34 of the cover member 20. The release button 40 has a plunger shaft 42 extending downwardly therefrom interiorly of the lower vertical segment 38 of the handle 34. The plunger shaft 42 has a spring 44 disposed on a lower end thereof biasing the plunger shaft 42 and the release button 40 upwardly. The closing assembly includes an inner gear track 46 and an outer gear track 48. The inner gear track 46 is disposed horizontally within the internal chamber 28 and coupled with the slide plate 32. The outer gear track 48 is coupled with the plunger shaft 42. The closing assembly includes a drive shaft 50 extending between the inner and outer gear tracks 46, 48. The drive shaft 50 has an inner end and an outer end. The inner and outer ends each have a gear 52 secured thereto for engaging the inner and outer gear tracks 46, 48.

In use, the closing assembly will keep the slide plate 32 in a closed orientation, thereby closing the aperture 30 to prevent a beverage from being dispensed through the aperture 30. In order to expose the aperture 30, the user would press down on the release button 40 which will cause the plunger shaft 42 to move downwardly against the urging of the spring 44. This action will cause the outer gear track 48 to move down against the gear 52 resulting in the rotation of the drive shaft and the other gear 52 within the internal chamber 32. This gear 52 will engage the inner gear track 46 thereby causing the slide plate 32 to move and expose the aperture 30.

What is claimed is:

1. A non-spill beverage container that requires a user to select when, or when not to drink their beverage, comprising, in combination:

a container adapted for holding a quantity of a beverage therein, the container having an open upper end and a closed lower end, the open upper end having external threads thereon;

a cover member adapted for removably coupling with the open upper end of the container, the cover member including a planar circular plate, the cover member including a lower peripheral flange extending downwardly from the circular plate, the lower peripheral flange being internally threaded for engaging the external threads of the open upper end of the container, the cover member including an upper peripheral flange extending upwardly from the circular plate, the circular plate having an internal chamber, the circular plate having an aperture therethrough and through the internal chamber, the cover member including a slide plate disposed within the internal chamber for selectively closing the aperture, the cover member having an inverted L-shaped handle secured to the lower peripheral flange, the handle having an upper horizontal segment and a lower vertical segment; and a closing assembly adapted for maintaining the slide plate in a closed orientation over the aperture of the cover member, the closing assembly including a release button extending outwardly of the upper horizontal segment of the handle of the cover member, the release button having a plunger shaft extending downwardly therefrom interiorly of the lower vertical segment of the handle, the plunger shaft having a spring disposed on a lower end thereof biasing the plunger shaft and the release button upwardly, the closing assembly including an inner gear track and an outer gear track, the inner gear track being disposed horizontally within the internal chamber and coupled with the slide plate, the outer gear track being coupled with the plunger shaft, the closing assembly including a drive shaft extending between the inner and outer gear tracks, the drive shaft having an inner end and an outer end, the inner and outer ends each having a gear secured thereto for engaging the inner and outer gear tracks.

2. A non-spill beverage container that requires a user to select when, or when not to drink their beverage, comprising, in combination:

a container adapted for holding a quantity of a beverage therein, the container having an open upper end and a closed lower end;

a cover member adapted for removably coupling with the open upper end of the container, the cover member including a planar circular plate, the circular plate having an internal chamber, the circular plate having an aperture therethrough and through the internal chamber, the cover member including a slide plate disposed within the internal chamber for selectively closing the aperture, said cover member further including a lower peripheral flange extending downwardly from the circular plate, and an inverted L-shaped handle secured to the lower peripheral flange, the handle having an upper horizontal segment and a lower vertical segment, and the lower peripheral flange being internally threaded for engaging external threads on the open upper end of the container; and a closing assembly adapted for maintaining the slide plate in a closed orientation over the aperture of the cover member, the closing assembly having a release button extending outwardly of the upper horizontal segment of the handle of the cover member, the release button having a plunger shaft extending downwardly therefrom interiorly of the lower vertical segment of the handle, the plunger shaft having a spring disposed on a lower end thereof biasing the plunger shaft and the release button upwardly, the closing assembly including an inner gear track and an outer gear track, the inner gear track being disposed horizontally within the internal chamber and coupled with the slide plate, the outer gear track being coupled with the plunger shaft, the closing assembly including a drive shaft extending between the inner and outer gear tracks, the drive shaft having an inner end and an outer end, the inner and outer ends each having a gear secured thereto for engaging the inner and outer gear tracks.

3. The non-spill beverage container as set forth in claim 2, wherein the cover member includes an upper peripheral flange extending upwardly from the circular plate.

* * * * *